United States Patent [19]

Miller et al.

[11] 3,949,430

[45] Apr. 13, 1976

[54] PORTABLE TOILET

[75] Inventors: Marshall W. Miller; Arthur W. Henke; John M. Antos, all of Ann Arbor, Mich.

[73] Assignee: Thetford Corporation, Ann Arbor, Mich.

[22] Filed: Jan. 20, 1975

[21] Appl. No.: 542,430

[52] U.S. Cl. ..... 4/76; 4/77; 4/78; 4/79; 4/80; 4/90; 4/92

[51] Int. Cl.[2]E03D 7/00; E03D 11/10; A47K 11/02; E03D 11/11

[58] Field of Search..... 4/10, 78, 79, 115, 1, 77, 4/80, 76, 85, 93, 116, 90, 92

[56] References Cited

UNITED STATES PATENTS

| | | | |
|---|---|---|---|
| 3,570,018 | 3/1971 | Sargent et al. | 4/115 |
| 3,713,177 | 1/1973 | Tufts | 4/95 |
| 3,801,991 | 4/1974 | Fulton et al. | 4/115 |
| 3,851,339 | 12/1974 | Flinner | 4/115 |
| 3,858,249 | 1/1975 | Howard | 4/10 |

*Primary Examiner*—Henry K. Artis
*Attorney, Agent, or Firm*—Olsen and Stephenson

[57] ABSTRACT

A self-contained portable sanitation unit formed in two vertically stacked sections. The top section includes a seat and cover, a bowl having an outlet port at its bottom, walls defining with the bowl a flush water chamber surrounding the bowl, and pump flush apparatus for discharging flush water into the bowl. The pump apparatus and the bowl are constructed and arranged to assure that the flush water is discharged from a discharge nozzle in a stream against the bowl wall so as to substantially eliminate "spitting" or other undesirable splashing of water thereby eliminating need for a flush rim. The lower section functions as a holding tank and is sealed from the environment by a manually actuated slide valve assembly which has its valve body and valve blade located within the holding tank to conserve vertical space, and the handle for the valve blade is located at the front of the unit. The sections are releasably secured together by a clasp mechanism located between the sections and the clasp handle is also located at the front of the unit, thereby minimizing space requirements on opposite sides of the unit. Similarly, clamp brackets for clamping the holding tank section to a support surface can be released from a frontal position and the top section alone or the two sections can be removed from a frontal position.

19 Claims, 13 Drawing Figures

FIG. 11
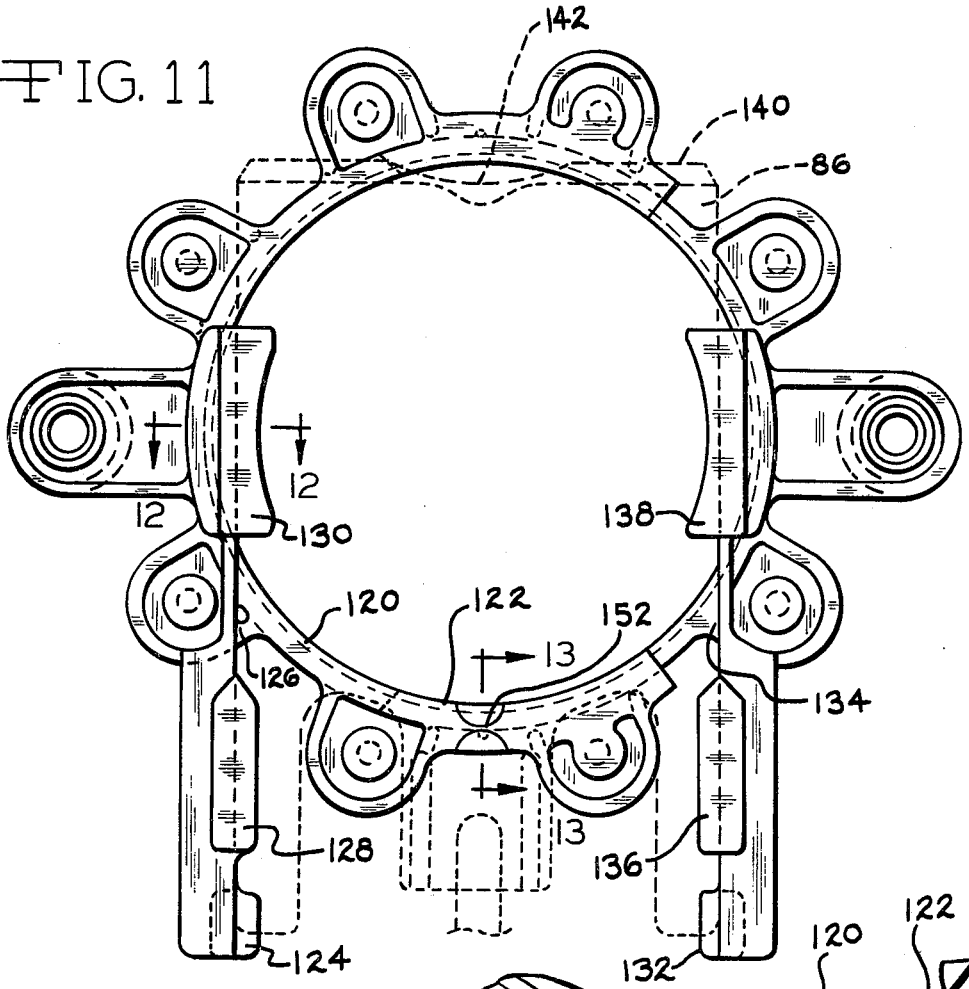
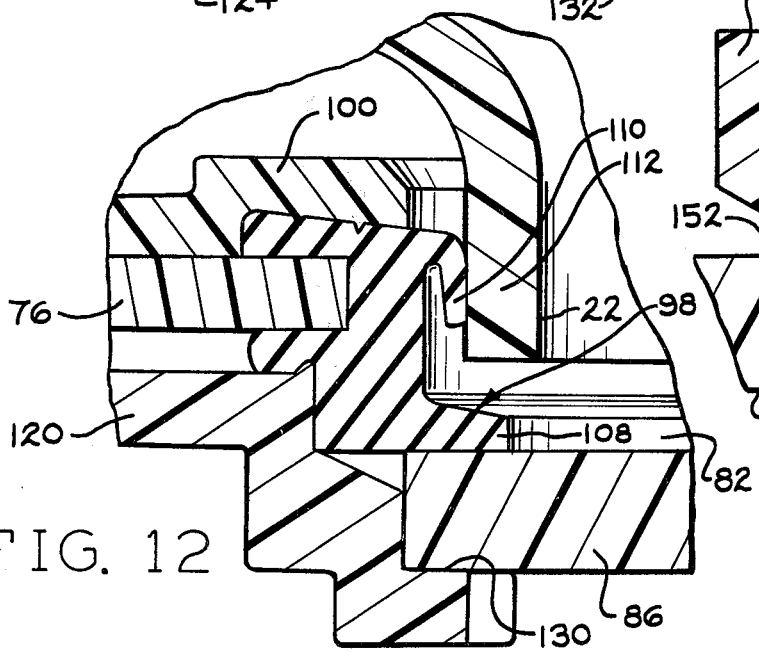
FIG. 12
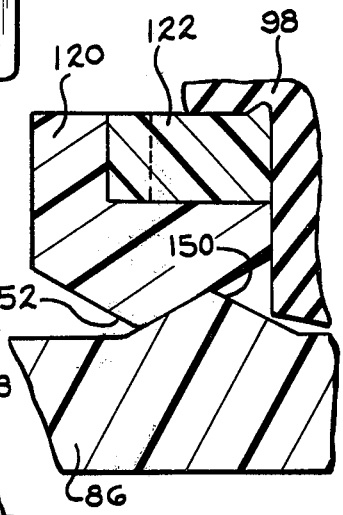
FIG. 13

PORTABLE TOILET

BACKGROUND OF THE INVENTION

The present invention relates to a portable toilet of the type disclosed in U.S. Pat. No. 3,570,018, issued Mar. 16, 1971 to Sargent, et al., and is particularly directed to improvements in toilets of this character.

With the advent of the portable toilet disclosed in the aforesaid patent, a substantial advance was made over prior art portable toilets as then known, particularly with respect to those used in the travel and recreational fields. Because space often is at a premium where these units are stored or used, efforts have been made to make the toilets as small and compact as possible within limits permitted without impairing the functions and operations thereof. The dimensions have been dictated by minimum capacity requirements for the flush water chamber and the holding tank; the vertical dimensions required to accommodate the flat slide valve assembly associated with the holding tank for closing and opening the latter; and the lateral dimensions required, not only for the toilet but with respect to the location where the toilet may be mounted, so that the seat section, as well as the holding tank section, can easily be secured in place or removed for servicing, or the like. Further, the demands to conserve space have been made concurrently with other demands to reduce costs and to assure optimum operating conditions, such as to eliminate unwanted splashing or spitting at the flush nozzles, sometimes associated with bellows-type hand pump generally used with these toilets for flush purposes, and to eliminate servicing and cleaning problems sometimes arising in connection with the slide valve assembly.

Summary of the Invention

The present invention has overcome inadequacies of the prior art and has provided a portable toilet characterized by its compactness, low cost, ease of servicing, and convenience and efficiency of operation.

According to one form of the present invention, a portable toilet is provided comprising a portable lower holding tank section and a portable upper seat section removably supported thereon. The seat section has top, side and bottom walls with an outlet port in its bottom wall and defines a bowl extending between the top and bottom walls and opening at the bottom to said outlet port. The holding tank section has a top wall and side and bottom walls that form a closed receptacle with an inlet port in its top wall in registry with the outlet port. A flat slide valve assembly is mounted on the holding tank section and defines the inlet port. The slide valve assembly includes a flat blade supported within the confines of the holding tank for movement in a plane perpendicular to the axis of the inlet port for closing the inlet port and sealing the interior of the tank section from the environment. The inlet port of the holding tank section is defined by an elastomeric seal which serves to provide a sealing relationship with the outlet port of the upper seat section, a sealing relationship with the flat blade when the flat blade is in its closed position, and a sealing relationship with the top wall of the holding tank section. The valve body of the valve assembly is secured within the holding tank section and provides guide surfaces for movement of the flat blade between its open and closed positions. For the purpose of moving the flat blade, a shaft is connected to the blade and extends through the front wall of the holding tank section. By virtue of this construction and arrangement a valve assembly is provided which allows the vertical dimensions of the portable toilet to be maintained at a minimum while still making optimum utilization of the water storage capacity of the upper seat section and the waste storage capacity of the holding tank section.

Another feature of the present invention that facilitates use of the improved slide valve assembly includes the construction and arrangement wherein in the shaft of the slide valve assembly is provided with a protective bellows so that the shaft is not exposed to the contents of the holding tank. Still another feature of the slide valve assembly is the construction and arrangement of the flat blade and the arrangement wherein the front edge of the blade will move most effectively against the elastomeric annular seal when moved to a closed position and will avoid trapping solid particles between the forward edge of the blade and the seal or valve body.

Still another feature of the present invention which contributes to most effective utilization of space in the area where the portable toilet may be supported is the arrangement of holddown brackets for supporting the holding tank section on a supporting surface. In the preferred embodiment of the invention a pair of holddown brackets are provided which are adapted to be attached to a supporting surface on opposite sides of the holding tank section. Each bracket is shaped to extend upward from the point of attachment and to terminate at the upper end in an inwardly turned hook that fits over the top wall of the holding tank section. The top wall of the holding tank section has at its side edges recessed portions for receiving the ends of the hooks. The recessed portions extend to the rear of the holding tank section so that the holding tank section can be moved forward without obstruction from the hooks when the hooks are aligned in a selected location in the recessed portions. The top wall of the holding tank section has sockets offset from the aforesaid recessed portions into which the hooks normally can be seated to restrict movement of the holding tank section. However, when it is desired to remove the holding tank section, this can be accomplished merely by deflecting the holddown brackets into proper alignment with the recessed portions and the holding tank section can then be removed from its supported position merely by pulling the holding tank forward. Thus, the need for lateral space for releasing the brackets is substantially eliminated.

Still another feature of the present invention which contributes economy of space is the clasp mechanism which secures the holding tank section and the upper seat section together. The clasp mechanism includes a pair of straps positioned on opposite sides of the outlet and inlet ports which are secured to the bottom wall of the upper seat section for limited movement by a handle which extends to the front side of the portable toilet. The lower holding tank section has a pair of elevated screws located in the paths of movements of the straps, and each strap has a slot with an associated enlarged opening of a size sufficient to receive one of the heads of the retention screws. The straps have inclined portions adjacent to the slots so that movement of the straps by the handle to a closed position after the screw heads have been inserted into the enlarged openings will cause vertical movement of the sections relative to one another to be urged then together. Thus, the handle of the clasp mechanism, the handle of the valve assembly and the holddown brackets for securing the portable toilet on a supporting surface can all be actuated from a frontal position so that relatively little space is required on opposite sides of the portable toilet in the area where it may be mounted. Thus, economy of space is realized not only from the reduced vertical dimensions of the portable toilet, but also with respect to the vehicle or other structure in which the portable toilet is mounted because only very limited space is required on opposite sides of the portable toilet for operating and servicing the same.

Still another feature of the present invention which contributes to its minimum size and low cost is the construction and arrangement of the pump flush apparatus and the upper portion of the bowl where the flush water is discharged by the pump flush apparatus. To eliminate the need for a flush ring at the upper edge of the bowl and to avoid undesirable spitting or splashing which sometimes may occur when using conventional bellows-type hand pumps for discharging a measured volume of water into a bowl, a unique arrangement of a ramp is provided around the upper periphery of the bowl in conjunction with a unique arrangement of the discharge nozzle from the pump flush apparatus. In this arrangement the flush water is initially directed toward the rear of the toilet. Further, a flush-dampening reservoir means is incorporated in the pump flush apparatus so as to aid in providing a more uniform flow of flush water into the bowl which will minimize spitting or the like.

Thus, it is an object of the present invention to provide an improved portable toilet which has various features which contribute to the production of a relatively low cost portable toilet which is efficient in operation and convenient for servicing and which is characterized by the economy of space that is realized in connection with its construction and in the space of the supporting structure where the toilet may be mounted.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 11 is an enlarged bottom plan view of the valve body of the flat slide valve assembly;

FIG. 12 is an enlarged fragmentary section taken on the lines 12—12 of FIG. 11, showing the position of the outlet port of the upper seat section in sealing arrangement with the sealing ring of the flat slide valve assembly; and FIG. 13 is an enlarged fragmentary section taken on the lines 13—13 of FIG. 11.

DESCRIPTION OF THE PREFERRED EMBODIMENT

Figure 1:
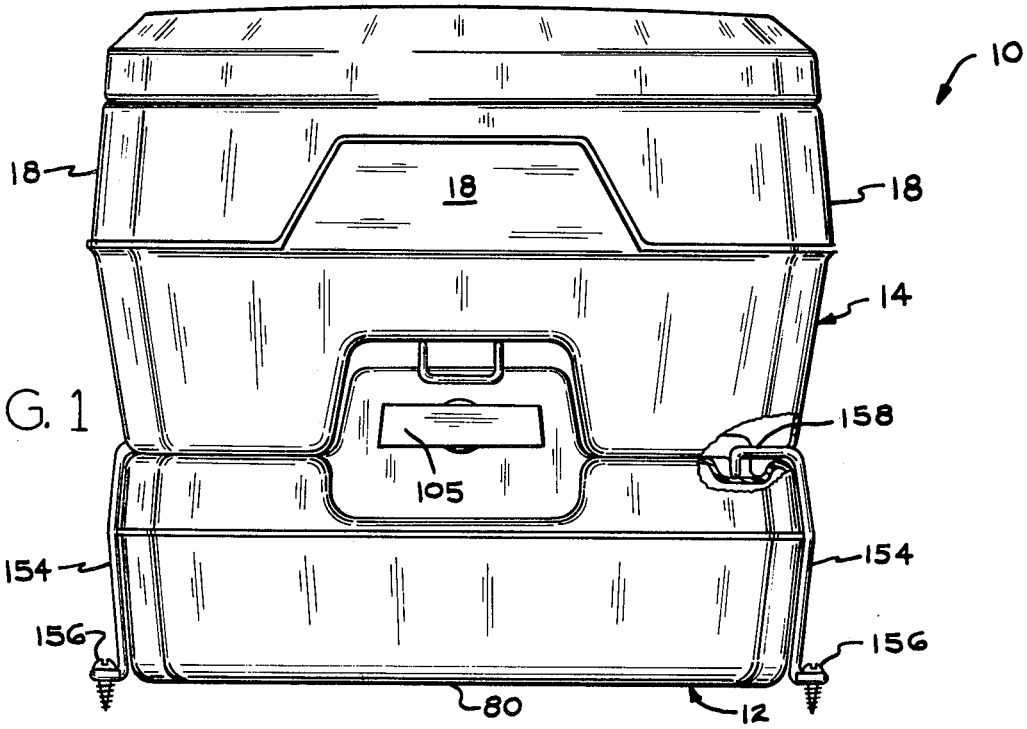
FIG. 1 is a front elevational view of a portable toilet embodying one form of the present invention, a portion being broken away to illustrate details of the supporting bracket for securing the holding tank section to a supporting surface.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The portable toilet 10 comprises the lower holding tank section 12 and the upper seat section 14 removably supported thereon. The upper seat section 14 is molded of a suitable plastic material so as to have a top wall 16, side walls 18 and a bottom wall 20 with an opening 22 in the bottom wall providing an outlet port. The upper seat section also defines a bowl 24 extending between the top and bottom walls 16 and 20, which opens at the bottom to said outlet port 22. A flush water compartment 26 is provided in the space surrounding the bowl 24 within the side walls 18 and the top and bottom walls 16 and 20. A fill opening spout 28 is provided in the rear side wall 18 for filling flush water into the flush water compartment 26, and a closure cap 30 is provided for closing the spout 28. A handle 32 is also molded in the rear side wall 18 for carrying the upper seat section 14.

Figure 2:
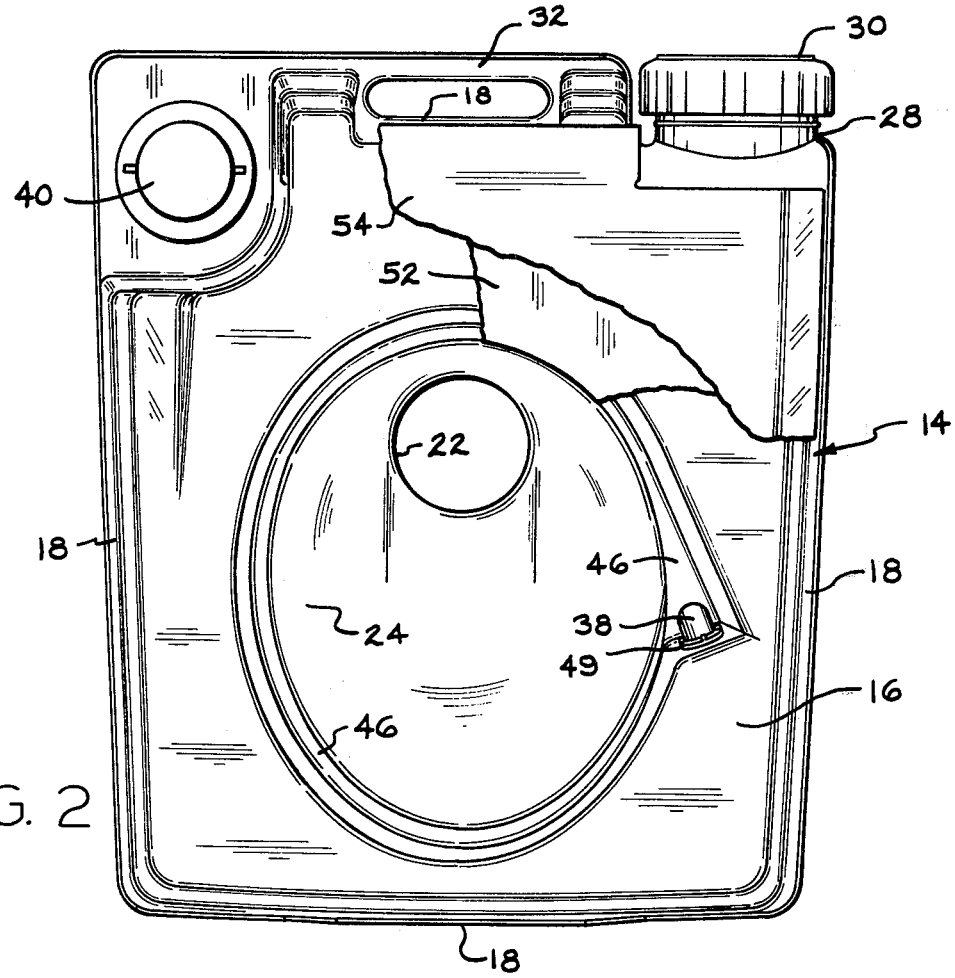
FIG. 2 is a top plan view of the portable toilet with portions of the top cover and seat broken away to illustrate details of the toilet bowl.
Figure 6:
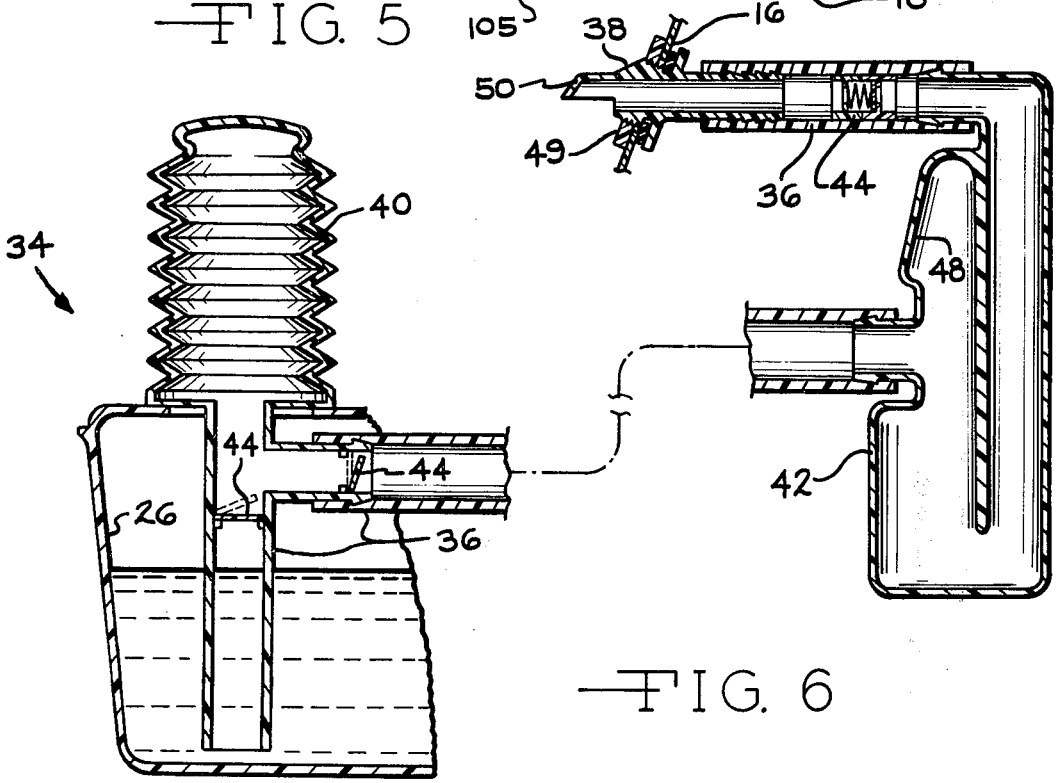
FIG. 6 is a fragmentary section taken through the upper seat section on a line illustrating details of the pump flush assembly.

The upper seat section 14 also contains pump-flush apparatus 34 which includes the passageway 36, a discharge nozzle 38, a flushing plunger or bellows pump 40, a flush-dampening resevoir means 42, and the plurality of check valves 44 that are found in the passageway 36. The bellows pump 40 functions the same as the corresponding part disclosed in the aforesaid U.S. Pat. No. 3,570,018, to which reference is made for a more detailed description. In the conventional manner, depressing the bellows 40 will serve to discharge water from the flush water chamber 26 through the flush-dampening resevoir means 42 and out the nozzle 38 to the inclined spiral ledge 46 in the bowl 24. The flush-dampening reservoir means 42 has a pocket or chamber 48 in which an air cushion is provided to cushion the pressure of the water that is discharged by action of the bellows pump 40 to provide a more uniform pressure and elimination of air bubbles in the stream of water that is discharged from the nozzle 38, thereby tending to eliminate the spitting action that sometimes occurs in connection with pump apparatus of the type using a bellows pump 40. When using pumps of this character it is not uncommon for bubbles of air to exist in the water circuit and these bubbles become pressurized during the pumping so as to cause a spitting action of the water as it leaves the nozzle 38. To overcome this undesirable characteristic the chamber 48 will serve to trap such bubbles, and the air that is then trapped in the chamber 48 will act as an air cushion to cause a more uniform discharge of the water through the nozzle 38. The flush-dampening reservoir means 42 can easily be installed within the upper seat section 14 by passing it through the spout 28 after which the flush-dampening reservoir means can be secured in place by the nut which is threadedly connected to the nozzle 38 and when screwed in place the discharge end will clamp onto the inclined surface of the top wall 16 as shown best in FIGS. 2 and 6. The nozzle 38 also has a shield portion 50 which projects from the upper edge of the nozzle outlet for positively directing the water into the bowl and onto the spiral ledge 46. The nozzle is mounted so as to direct the stream of water toward the rear of the toilet bowl 24 in a direction to minimize splashing of any water from the bowl to the surrounding area.

Also forming a part of the upper seat section 14 is the toilet seat 52 and the cover 54. It will be noted that the toilet seat 52 extends over the spiral ledge 46. Positioned above the toilet seat 52 is the cover 54, both of which are supported on common hinge posts, not shown, located adjacent to the rear edge of the top wall 16.

Figure 3:
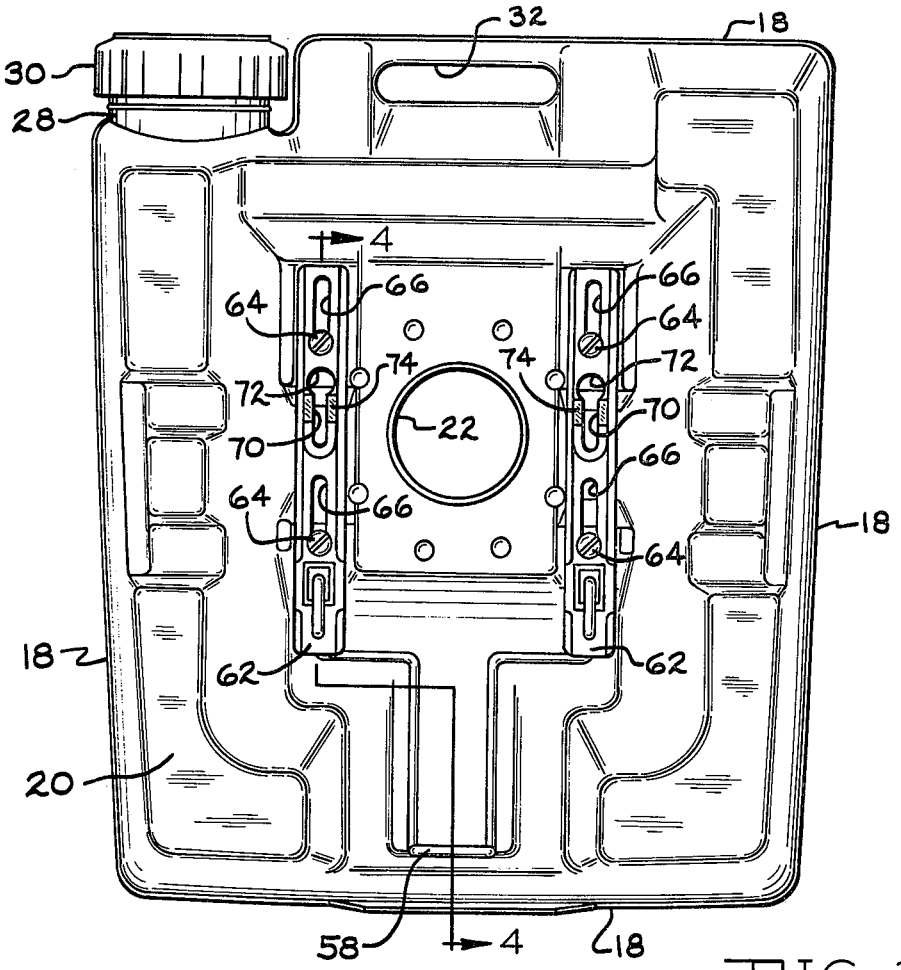
FIG. 3 is a bottom plan view of the upper seat section.

One of the features of the present invention is the clasp mechanism 56 for releasably securing the upper seat section and the lower holding tank section together. A portion of this mechanism is mounted on the bottom wall 20 of the upper seat section 24 and the remainder of the clasp mechanism is secured to the top wall of the holding tank section 12, as will presently be described. With respect to the upper seat section 14, the clasp mechanism includes a handle 58 which is located in the cavity 60 defined by the front side walls of the upper seat section 14 and the holding tank section 12, as can be seen best in FIG. 4. The handle 58 is connected to a pair of straps or members 62 which are secured to the bottom wall 20 for limited movement by the plurality of screws or members 64. As can be seen in FIG. 3, the screws 64 extend through the slots 66 with the heads being held in spaced relationship to the bottom wall 20 by means of a plurality of spacers 68, FIG. 4, so that the straps 62 can move lengthwise the length of the slots 66. The straps 62 also have an additional pair of slots 70 which have enlarged openings 72 at one end and inclined surfaces 74 adjacent hereto for a purpose that will be described hereinafter.

The lower holding tank section 12 has a top wall 76, side walls 78 and a bottom wall 80 forming a closed receptacle with an inlet port 82 in its top wall in registry with the outlet port 22 of the upper seat section 14. A flat slide valve assembly 84 is mounted on the holding tank section 12 and defines the inlet port 82. The slide valve assembly includes the flat blade or valve element 86 which is supported within the confines of the holding tank section for movement in a horizontal plane perpendicular to the axis of the inlet port 82 for closing the inlet port and sealing the interior of the holding tank section 12 from the environment.

The rear side wall 78 includes the handle 88 for carrying the holding tank section and it also includes a spout 90 which may be used for evacuating the holding tank and which normally is closed by the closure cap 92.

Figure 4:
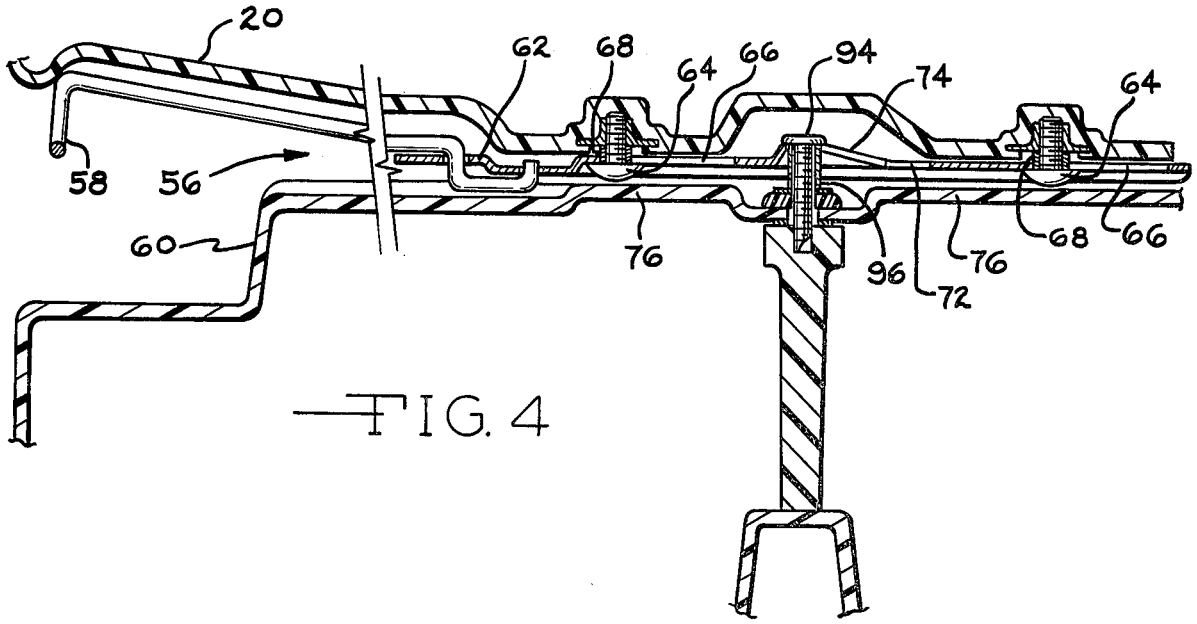
FIG. 4 is an enlarged fragmentary section taken on the lines 4—4, illustrating the details of the clasp mechanism for securing the upper and lower sections together.
Figure 5:
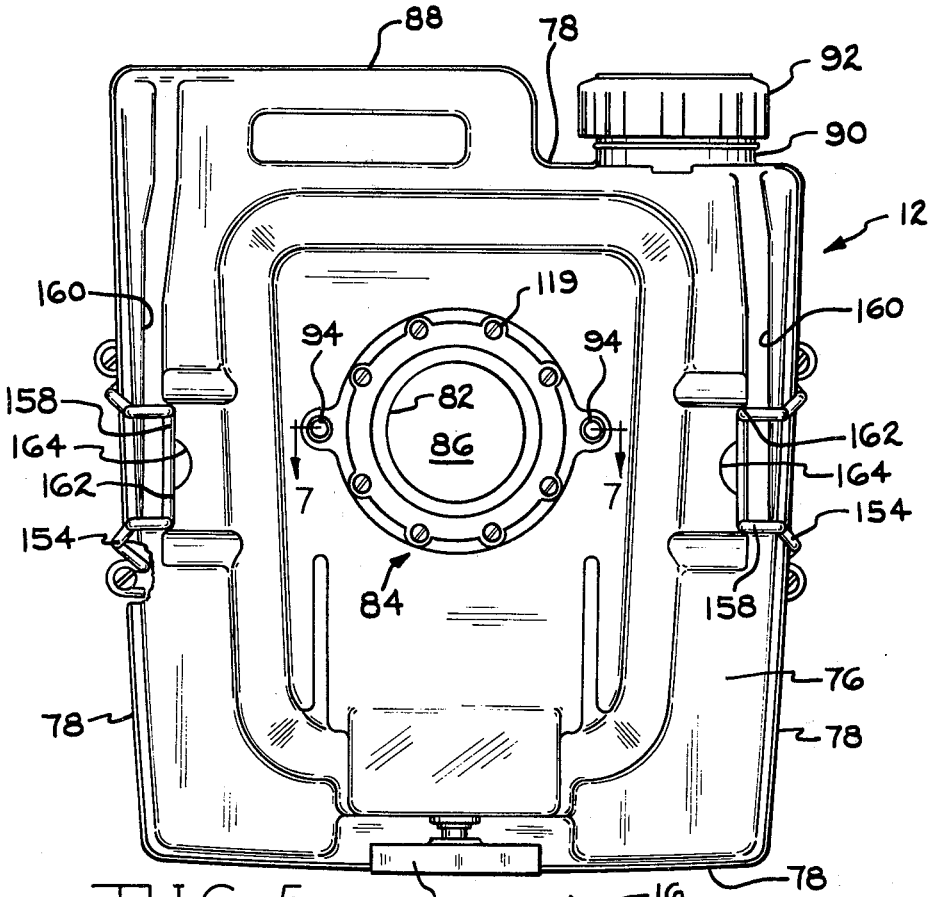
FIG. 5 is a top plan view of the lower holding tank section.

Referring now to FIGS. 4 and 5, it can be seen that the top wall 76 of the lower holding tank section 12 includes a pair of screws 94 which have their heads spaced from the upper surface of the top wall 76 by the spacers 96. When it is desired to clasp the upper seat section 14 firmly to the lower seat section 12, this can readily be accomplished merely be placing the upper seat section 14 onto the lower seat section 12 so that the openings 72 of the straps 62 fit over the heads of the screws 94 after which the handle 58 can be moved inwardly causing the heads 94 to slide up the inclined surfaces 74 to the position shown in FIG. 4, thereby urging the two sections together. When it is desired to disconnect the two sections, this can readily be accomplished merely by lowering the handle 58 from the position shown in FIG. 4 and pulling it to the left until the heads of the screws 94 are in alignment with the openings 72, after which the upper seat section 14 can be removed from the lower holding tank section 12.

Another of the features of the present invention is the construction and the arrangement of the flat slide valve assembly 84. The flat slide valve assembly 84 includes the elastomeric annular seal 98, the upper annular seal cover 100, the annular valve 102, the flat blade 86, the shaft 104 that is connected at one end to the flat blade 86, the valve handle 105 connected to the other end of the shaft 104, and the protective bellows 106 which protects the shaft 104 from the contents of the holding tank section 12. The various details of these components of the flat slide valve assembly 84 will be described with particular reference to FIGS. 7—13, inclusive.

Figure 7:
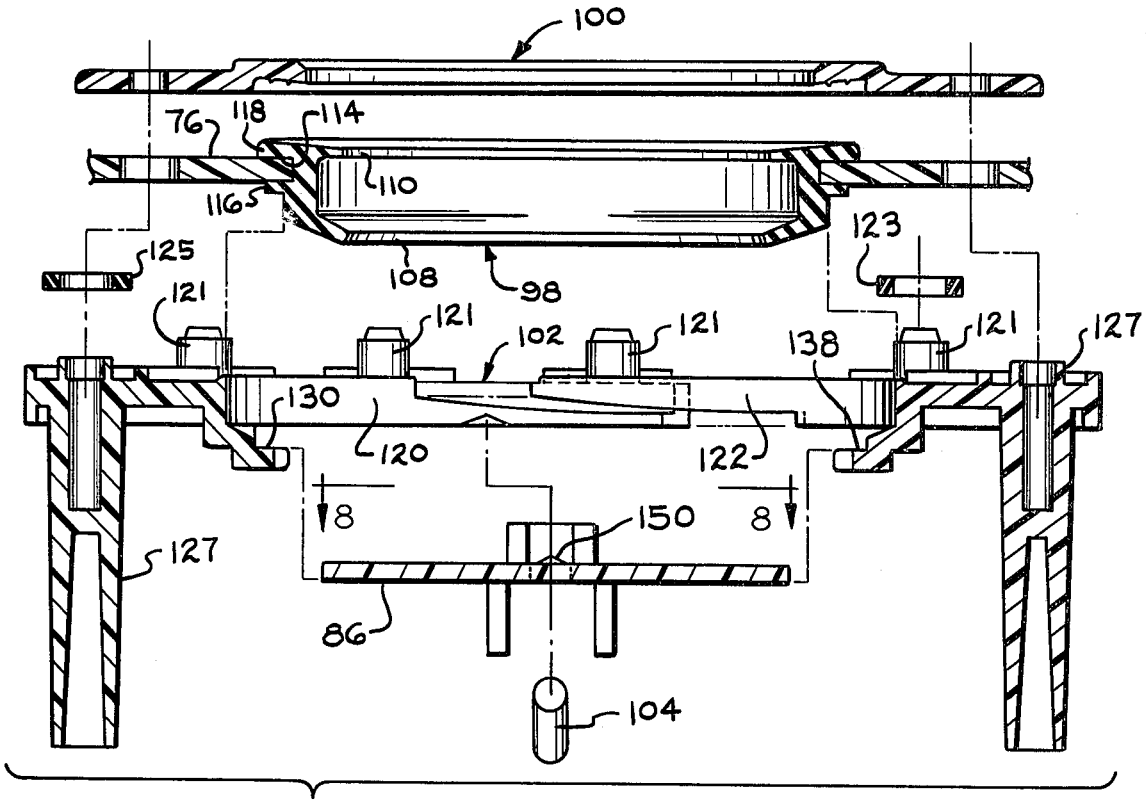
FIG. 7 is an enlarged exploded view taken on the lines 7—7 of FIG. 5, showing details of the flat slide valve assembly.
Figure 8:
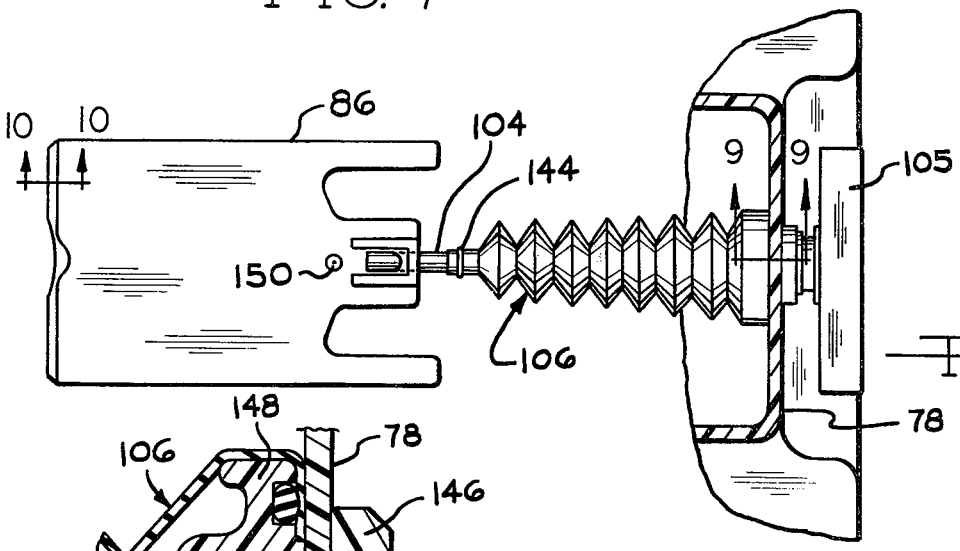
FIG. 8 is a sectional view taken on the lines 8—8 of FIG. 7, showing the flat blade and the arrangement for mounting it on the front side wall of the lower holding tank section.

As can be seen best in FIG. 7, the elastomeric annular seal 98 has a lower lip 108 around its inner periphery which is adapted to be engaged by the upper surface of the flat blade 86 when the latter is in its closed position under the inlet port 82 defined by the annular seal 98. In its unstressed position the lower lip 108 will be in the position shown in FIG. 7, but when the flat blade 86 is moved to its closed position, shown in FIG. 12, the lip 108 will be deflected upward as there shown, to provide a tight seal between the blade and the lip 108.

The annular seal 98 also has an upper lip 110 around its inner periphery which is adapted to be engaged by the downwardly directed annular flange 112 that forms the lower end of the bowl 24 and defines the outlet port 22 from the upper seat section 14. As can be seen best in FIG. 12, when the upper seat section 14 is pressed into place on the lower holding tank section 12, the upper lip 110 will be stretched into sealing engagement with the outer surface of the annular flange 112 to provide a sealing relationship between the upper seat section 14 and the lower holding tank section 12 at the outlet port 22 and the inlet port 82. This arrangement also allows relatively flexible manufacturing tolerances in the upper and lower sections 14 and 12, because the extent of penetration of the annular flange 112 can vary while still providing a satisfactory sealed relationship.

The annular seal 98 also has a groove around its outer periphery at 114 so as to have overlapping edges 116 and 118 with respect to the top wall 76 of the holding tank section 12. The fastening screws 119 which extend through the cover 100 serve to clamp the cover 100 against the edge 118 to provide a tight seal at this joint. Similarly, the edge 116 is firmly clamped against the top wall 76 by the same screws 119 which are threadedly connected to the bosses 121 of the valve body 102 and hold the valve body 102 firmly to the underside of the top wall 76. Seal rings 123 fit around bosses 121 to assure leak proof joints. Similar seal rings 125 are provided under screws 94 to provide leak proof joints where the screws 94 connect to the valve body 102 at the posts 127. These posts serve as support structures which may, if desired, engage portions of the bottom wall of the holding tank section 12.

Figure 10:
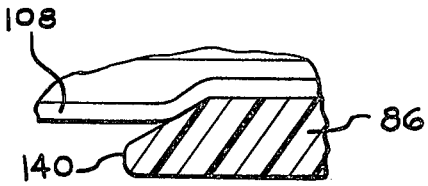
FIG. 10 is an enlarged fragmentary section taken on the lines 10—10 of FIG. 8.

For installation purposes, the valve body 102 comprises two annular segments 120 and 122 to permit the valve body to be inserted into the holding tank section 12 during initial assembly. The arcuate segment 120 includes vertically spaced guide surfaces for supporting the upper and lower surfaces of the flat blade 86. The upper guide surfaces include the surfaces 124 and 126, and the lower guide surfaces comprise the surfaces 128 and 130. Similarly, the valve body segment 122 includes the upper guide surfaces 132 and 134, and the lower guide surfaces 136 and 138. Thus, it can be seen that the flat blade 86 can move between open and closed positions on the guide surfaces provided in the valve body 102. When the flat blade moves under the elastomeric annular seal 98 it will engage the depending lip 108 to provide an effective sealing closure. It is to be observed that there are no abuttments against which the inner end or edge 140 of the blade 86 must engage. This serves to eliminate any problems that might otherwise arise where solid matter may be engaged by the edge 140 and trapped against an abutting surface of the valve body. The edge 140 is also constructed so as to be substantially straight with a concave portion at 142. It is found that this arrangement causes a progressively smooth sliding action of the lip 108 on the blade, as shown in FIG. 10. Where the blade 86 has a conventional straight or convex leading end, it is found that the lip 108 tends to slide on the edge in an uneven non-progressive manner, so that a point is reached at which a long arc length of the lip 108 must abruptly slide up over the edge of the blade, which often results in the lip 108 rolling under, thus assuming a configuration which cannot seal against the blade 86.

Figure 9:
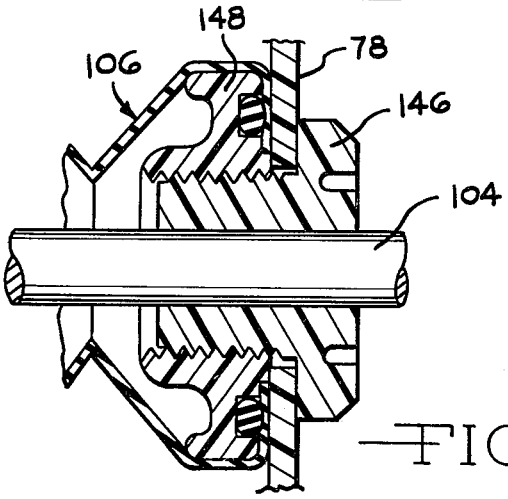
FIG. 9 is an enlarged sectional view taken on the lines 9—9 of FIG. 8.

In view of the fact that the shaft 104 is usually within the confines of the holding tank section 12, and the stem must slide out through the front wall 78 during opening of the valve assembly 84, a bellows 106 has been secured at one end by a spring clip 144, and the bellows has been secured to the front side wall 78 of the holding tank section 12 by the male retainer element 146 which is threadedly connected to the female retainer 148 to secure the bellows 106 in the manner shown in FIG. 9. This arrangement assures that the portion of the shaft that slides through the retainer element 146 will remain clean and uncorroded to assure easy movement and absence of leakage at this fitting.

It will be observed that the top surface of the flat blade 86 includes a small conical projection 150 which will function when the flat blade 86 is in its closed position to snap under the lower edge 152 of the body segment 120 to prevent the blade 86 from inadvertently moving to an open position, such as might occur if the portable toilet 10 were used, for example, in a recreational vehicle wherein vibration from the vehicle might be transmitted to toilet 10.

When it is desired to secure the portable toilet 10 to a supported structure, a pair of holddown brackets 154 may be employed. As shown best in FIGS. 1 and 5, each bracket is shaped to extend upward from the point of attachment at 156 upward to terminate at the upper end in an inwardly turned hook 158 that fits over the top wall 76 of the holding tank section 12. The top wall 76 has at its side edges recessed portions 160 for receiving the ends of the hooks 158, and the portions 160 extend to the rear of the holding tank section so that the latter can be moved forward from its supported area without obstruction from the hooks 158 when the hooks are aligned with the recessed portions 160. To prevent inadvertent movement of the holding tank section 12, sockets 162, which are offset from the recessed portions 160, are provided, and the resilient properties of the brackets 154 are such that they will normally be in the positions shown in FIGS. 1 and 5 preventing release of the holding tank section 12 for movement in a forward direction. When it is desired to release the holding tank section 12 from the brackets 154, this can be accomplished by an individual merely by making use of the finger holes 164 to urge the brackets outwardly to proper alignment with the recessed portions 160 and the holding tank section 12 can then be moved forward.

From the foregoing description it will be apparent that the handle 105 for the flat slide valve assembly 84 and the handle 58 for actuating the clamp mechanism 56 are both located on the front side of the portable toilet 10 for convenient actuation. Similarly, the brackets 54 can be operated for releasing the portable toilet from the front of the toilet and very little room on either side is required for this purpose. Thus, the portable toilet 10 can be supported in an area having relatively small width so as to conserve space in the recreational vehicle or the like. Furthermore, all of the dimensions in the toilet, by virtue of the construction and arrangement of the flat slide valve assembly 84 and the upper regions of the bowl 24 and the arrangement of the pump flush apparatus 34 are such as to provide maximum capacity while maintaining the vertical dimensions at a minimum.

It is claimed:

1. A portable toilet comprising a portable lower holding tank section and a portable upper seat section removably supported thereon, said seat section having top, side and bottom walls with an outlet port in its bottom wall and defining a bowl extending between said top and bottom walls and opening at the bottom to said outlet port, said holding tank section having a top wall and side and bottom walls forming a closed receptacle with an inlet port in its top wall in registry with said outlet port, and a flat slide valve assembly mounted on said holding tank section and defining said inlet port, said slide valve assembly including an annular valve body located within said holding tank section and having therein vertically spaced guide surfaces, a flat blade supported between said guide surfaces within the confines of the holding tank section for movement in a plane perpendicular to the axis of said inlet port for closing said inlet port and sealing the interior of said tank section from the environment.

2. A portable toilet comprising a portable lower holding tank section and a portable upper seat section removably supported thereon, said seat section having top, side and bottom walls with an outlet port in its bottom wall and defining a bowl extending between said top and bottom walls and opening at the bottom to said outlet port, said holding tank section having a top wall and side and bottom walls forming a closed receptacle with an inlet port in its top wall in registry with said outlet port, and a flat slide valve assembly mounted on said holding tank section and defining said inlet port, said slide valve assembly including a flat blade supported within the confines of the holding tank section for movement in a plane perpendicular to the axis of said inlet port for closing said inlet port and sealing the interior of said tank section from the environment, said inlet port being defined by an elastomeric annular seal that has a lower lip around its inner periphery, the upper surface of said flat blade when in an open position being in a plane above the lower extremity of said lower lip so as to engage and deflect said lip into a sealing relationship with the top surface of the flat blade when the latter is moved to a closed position under said inlet port.

3. The portable toilet that is defined in claim 2, wherein said flat blade has a forward edge that is perpendicular to the path of movement of the blade, said forward edge being generally straight with a concave midportion.

4. The portable toilet that is defined in claim 2, wherein said annular seal has an upper lip around its inner periphery, said outlet port having a downwardly directed annular flange extending into said upper lip in sealing relationship therewith.

5. The portable toilet that is defined in claim 2, wherein said annular seal has an outer periphery overlapping the upper and lower surfaces of the top wall of said holding tank section, and said flat slide valve assembly includes an upper annular seal cover in engagement with the upper portion of said outer periphery, and an annular valve body located within said holding tank section in engagement with the lower portion of said outer periphery, said annular seal cover and said annular valve body being secured together through the top wall of the holding tank section so as to clamp the outer periphery of said annular seal to said top wall of the holding tank section.

6. The portable toilet that is defined in claim 5, wherein said valve body includes vertically spaced guide surfaces for supporting upper and lower surfaces of said flat blade for movement of the latter between open and closed positions.

7. The portable toilet that is defined in claim 6, wherein said annular valve body comprises two annular segments secured together, each segment being dimensioned so that it can pass through the opening in the top wall of said holding tank section for initial assembly purposes.

8. The portable toilet that is defined in claim 1, wherein said flat slide valve assembly includes a shaft extending through one side wall of said holding tank section, said shaft being secured to said blade for movement of said blade within the confines of said guide surfaces between open and closed positions with respect to said inlet port.

9. The portable toilet that is defined in claim 8, wherein said flat slide valve assembly includes a protective bellows within said holding tank enclosing said shaft, said bellows being secured in sealed relationship on one end to said shaft adjacent to said flat blade and at the other end to said one side wall.

10. A portable toilet comprising a portable lower holding tank section and a portable upper seat section removably supported thereon, said seat section having top, side and bottom walls with an outlet port in its bottom wall and defining a bowl extending between said top and bottom walls and opening at the bottom to said outlet port, said holding tank section having a top wall and side and bottom walls forming a closed receptacle with an inlet port in its top wall in registry with said outlet port, and a valve assembly mounted on said holding tank section and defining said inlet port, said valve assembly including a valve element supported for movement for closing said inlet port and sealing the interior of said tank section from the environment, a pair of holddown brackets adapted to be attached to a supporting surface on opposite sides of said holding tank section, each bracket being shaped to extend upward from the point of attachment and to terminate at the upper end in an inwardly turned hook that fits over the top wall of said holding tank section, said top wall of the holding tank section having at its side edges recessed portions for receiving ends of the hooks, said recessed portions extending to the rear of said holding tank section so that said holding tank section can be moved forward without obstruction from said hooks when the hooks are aligned at a selected location in said recessed portions.

11. The portable toilet that is defined in claim 10, wherein said top wall of said holding tank section has sockets offset from said recessed portion into which said hooks can be seated to restrict movement of said holding tank section.

12. A portable toilet comprising a portable lower holding tank section and a portable upper seat section removably supported thereon, said seat section having top, side and bottom walls with an outlet port in its bottom wall and defining a bowl extending between said top and bottom walls and opening at the bottom to said outlet port, said holding tank section having a top wall and side and bottom walls forming a closed receptacle with an inlet port in its top wall in registry with said outlet port, and a valve assembly mounted on said holding tank section and defining said inlet port, said valve assembly including a valve element supported for movement for closing said inlet port and sealing the interior of said tank section from the environment, and a clasp mechanism releasably securing said sections together, the front side walls of said sections defining a cavity extending rearwardly toward the registered ports, said clasp mechanism including a handle located in said cavity and movable between open and closed positions and members positioned respectively on opposite sides of said inlet and outlet ports immediately adjacent thereto for selectively releasing or securing said sections together in response to movement of said handle.

13. A portable toilet comprising a portable lower holding tank section and a portable upper seat section removably supported thereon, said seat section having top, side and bottom walls with an outlet port in its bottom wall and defining a bowl extending between said top and bottom walls and opening at the bottom to said outlet port, said holding tank section having a top wall and side and bottom walls forming a closed receptacle with an inlet port in its top wall in registry with said outlet port, and a valve assembly mounted on said holding tank section and defining said inlet port, said valve assembly including a valve element supported for movment for closing said inlet port and sealing the interior of said tank section from the environment, a clasp mechanism releasably securing said sections together, the front side walls of said sections defining a cavity extending rearwardly toward the registered ports, said clasp mechanism including a handle located in said cavity and movable between open and closed positions for releasing and securing said mechanism for selectively releasing or securing said sections together, said clasp mechanism including a pair of straps positioned respectively on opposite sides of said outlet and inlet ports and secured to one of said sections for limited movement by said handle, the other of said sections having elevated retention screws located in the paths of movement of said straps, each strap having a slot and an associated enlarged opening of a size sufficient to receive one of the heads of said retention screws, said straps having inclined portions adjacent to said slots so that movement of said straps by said handle to said closed position after said heads have been positioned in said enlarged openings will urge said sections together.

14. The portable toilet that is defined in claim 13, wherein said inlet port has an elastomeric annular seal around its inner periphery and said outlet port has a downwardly directed annular flange fitting into said annular seal, the flange being urged into the seal by the action of said clasping mechanism.

15. The portable toilet that is defined in claim 12, wherein said valve assembly includes a shaft extending through the front side wall of said holding tank section, said shaft being secured at its inner end to said valve element for movement of the element between open and closed positions with respect to said port, and a valve handle mounted on the other end of said shaft so that front access can be gained to both the valve assembly and the clasp mechanism.

16. A portable toilet comprising a portable lower holding tank section and a portable upper seat section removably supported thereon, said seat section having top, side and bottom walls with an outlet port in its bottom wall and defining a bowl extending between said top and bottom walls and opening at the bottom to said outlet port, said holding tank section having a top wall and side and bottom walls forming a closed receptable with an inlet port in its top wall in registry with said outlet port, and a valve assembly mounted on said holding tank section and defining said inlet port, said valve assembly including a valve element supported for movement for closing said inlet port and sealing the interior of said tank section from the environment, said upper seat section including a storage chamber for flush water surrounding said bowl, and pump flush apparatus for discharging flush water from said storage chamber onto the upper surface of said bowl for flow toward said outlet port in a vortex pattern, said pump flush apparatus including a passageway with a nozzle positioned to discharge flush water to said bowl, a handbellows pump for pumping a volume of flush water from said storage chamber through said passageway to said nozzle, and a flush-dampening reservoir means located in said passageway between said pump and said nozzle providing an air cushion in the flush water discharge passageway.

17. The portable toilet that is defined in claim 16, wherein said nozzle extends through the wall of the bowl adjacent to the upper periphery thereof and is located at one side of the bowl so as to point to the rear of the toilet.

18. The portable toilet that is defined in claim 17, wherein said nozzle has a shield projecting forward from the upper edge of the nozzle outlet for positively directing water in said bowl.

19. The portable toilet that is defined in claim 17, wherein said bowl has a spiral ledge commencing at the location where said nozzle extends through the wall of the bowl.

* * * * *